US005139432A

United States Patent [19]

Sugiyama et al.

[11] Patent Number: 5,139,432

[45] Date of Patent: Aug. 18, 1992

[54] CONNECTOR LOCKING MECHANISM

[75] Inventors: Masaaki Sugiyama; Mamoru Araki; Toshio Suehisa, all of Shizuoka, Japan

[73] Assignee: Yazaki Corporation, Tokyo, Japan

[21] Appl. No.: 731,604

[22] Filed: Jul. 17, 1991

[30] Foreign Application Priority Data

Jul. 25, 1990 [JP] Japan ..... 2-78210[U]

[51] Int. Cl.[5] ..... H01R 13/62

[52] U.S. Cl. ..... 439/372

[58] Field of Search ..... 439/342, 345, 347, 350, 439/352-355, 357, 358, 372, 484, 680

[56] References Cited

U.S. PATENT DOCUMENTS 4,341,428 7/1982 Hatch et al. ..... 439/372
4,873,614 10/1989 Lichtensperger ..... 439/372 X
4,878,853 11/1989 Yamade et al. ..... 439/372 X
5,021,003 6/1991 Ohtaka et al. ..... 439/372 X

*Primary Examiner*—Neil Abrams
*Assistant Examiner*—Khiem Nguyen
*Attorney, Agent, or Firm*—Sughrue, Mion, Zinn, Macpeak & Seas

[57] ABSTRACT

A device for locking a pair of connectors to each other, in which a locking unit which is attached to the housing of one of the connectors in a pivotable manner, and is biased by a spring in a direction tending to unlock the connectors from each other. The locking unit includes a pair of support portions and a plate spring engagement portion. Support members are provided on the housing for receiving the support portion and a plate spring is resiliently disposed between the engagement portion and the housing.

6 Claims, 8 Drawing Sheets

CONNECTOR LOCKING MECHANISM

BACKGROUND OF THE INVENTION

1. Field of the Invention

The present invention relates to a mechanism for locking a pair of mating connectors together so that when the connectors are mated to each other, the pair is redundantly prevented from separating.

2. Description of the Prior Art

FIG. 14 illustrates a conventional device for preventing connectors attached to an electric connecting box and a wire harness respectively from being connected erroneously. In such a device, a plurality of fitting portions $\mathbf{102}_1$, $\mathbf{102}_2$, $\mathbf{102}_3$, . . . , each having a unique and independent shape, are provided on insulated box 101 of the electric connecting box A. A plurality of connectors $\mathbf{104}_1$, $\mathbf{104}_2$, $\mathbf{104}_3$, . . . , each corresponding to the respective fitting portions $\mathbf{102}_1$, $\mathbf{102}_2$, $\mathbf{102}_3$, . . . , are provided on an end portion of harnesses 103, respectively. Thereby, connectors $\mathbf{104}_1$, $\mathbf{104}_2$, $\mathbf{104}_3$, . . . , are prevented from being erroneously connected to respective fitting portions $\mathbf{102}_1$, $\mathbf{102}_2$, $\mathbf{102}_3$, . . . .

In order to maintain a connected status between connectors 104 and fitting portions 102, locking arm 105 having projection 106 is provided on connector 104. In addition, connecting portion 107 operatively engages with projection 106 when connectors 104 are connected to fitting portions 102.

In the above-mentioned conventional electric connecting box, confirmation of a connected status between connector 104 and fitting portion 102 is obtained through visual inspection by the person assembling the device as well as by the click sound being generated by the engagement of projection 106 with connecting portion 107.

However, the entire connecting operation is conducted manually. Accordingly, human error can cause an incomplete connection and locking to be overlooked. It is desirable to eliminate the possibility of such an error, especially in a circuit directly relating to a person's life such as an air bag mechanism, or the like.

SUMMARY OF THE INVENTION

It is an object of the present invention to provide an electric connecting box having a redundant locking mechanism and a mechanism for preventing erroneous connections.

Accordingly, it is an object of the present invention to provide a mechanism for locking a pair of connectors to each other wherein it is simple to attach the locking unit of the mechanism to the housing of one of the connectors. The locking unit is attached to the housing so as to be pivotable and is biased by a spring in a direction tending to unlock the connectors from each other. The locking unit includes a pair of support portions having pivotally coupled parts, and a plate spring engagement portion. Support members are provided on the housing of the connector, and a plate spring is resiliently provided as the above-mentioned spring between the plate spring engagement portion and the housing. The plate spring is fitted at one end thereof in the locking unit and engaged at the other end thereof on the housing. The support portions are pushed so that they are fitted in the support members and the pivotally-coupled parts of the support portions are engaged in the pivotal coupling parts of the support members.

The nature, principle and utility of the present invention will become apparent from the following detailed description of its operation and the accompanying drawings.

Figure 3:
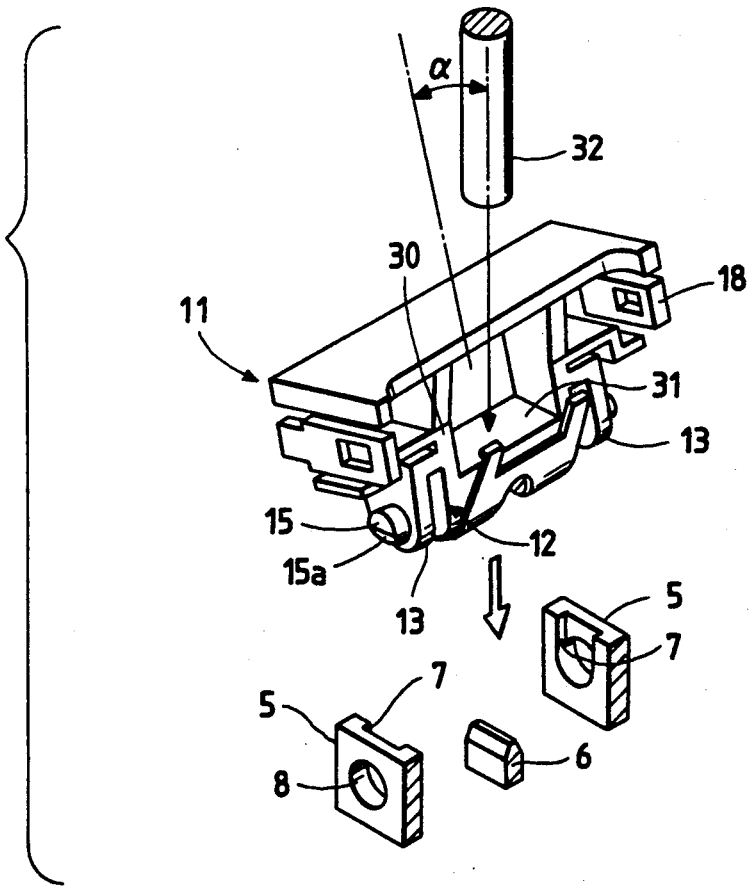
Figure 4:
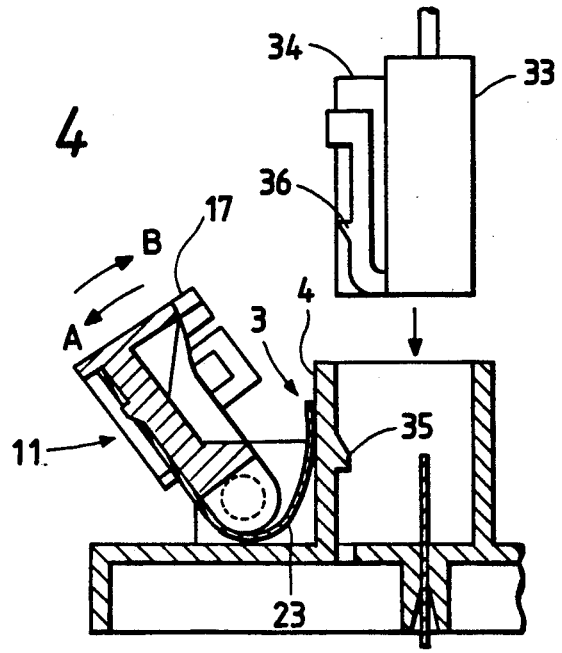
Figure 5:
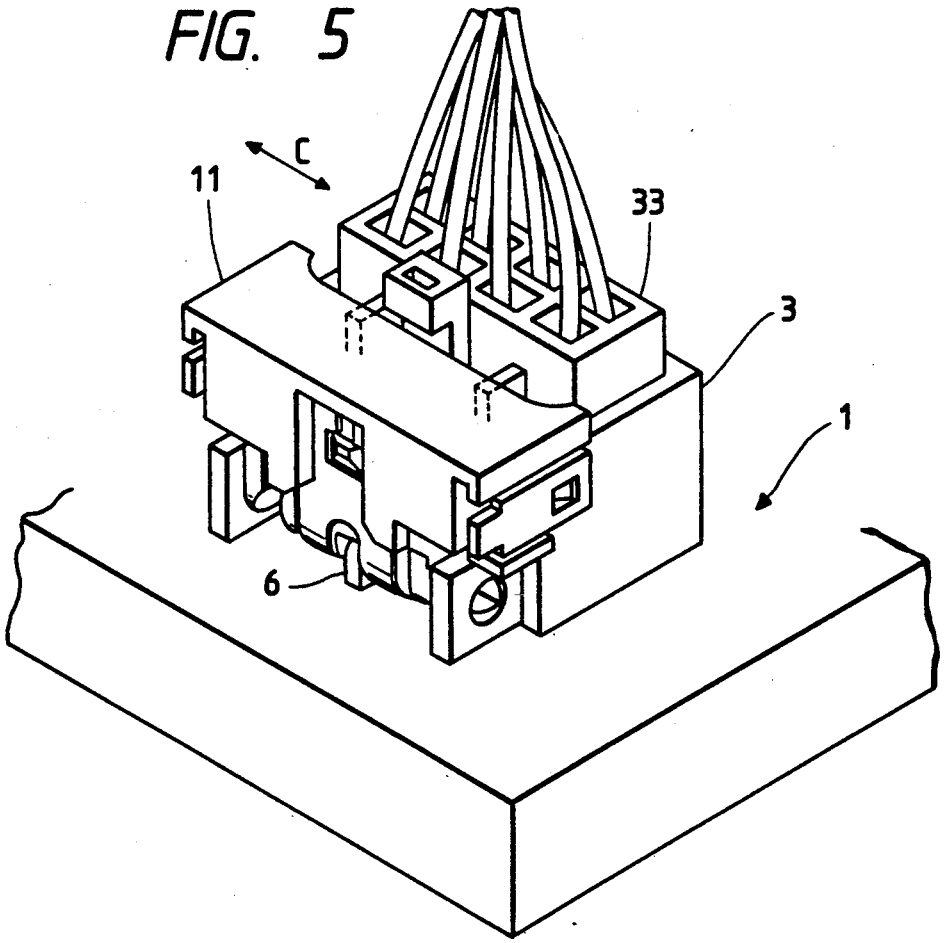
Figure 6:
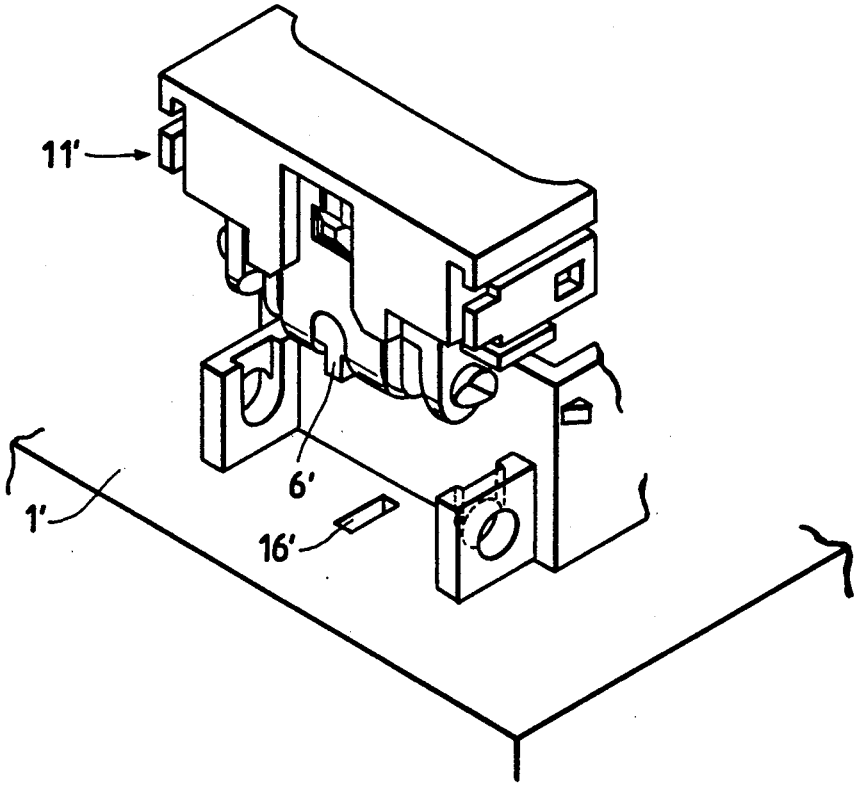
Figure 7:
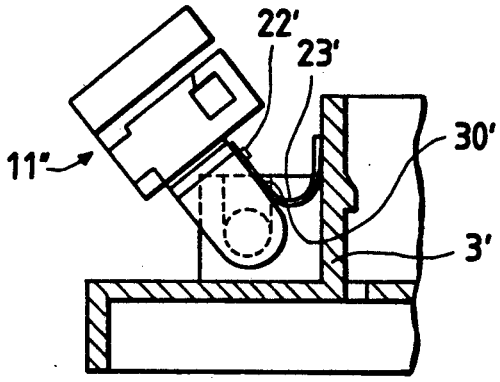
Figure 8:
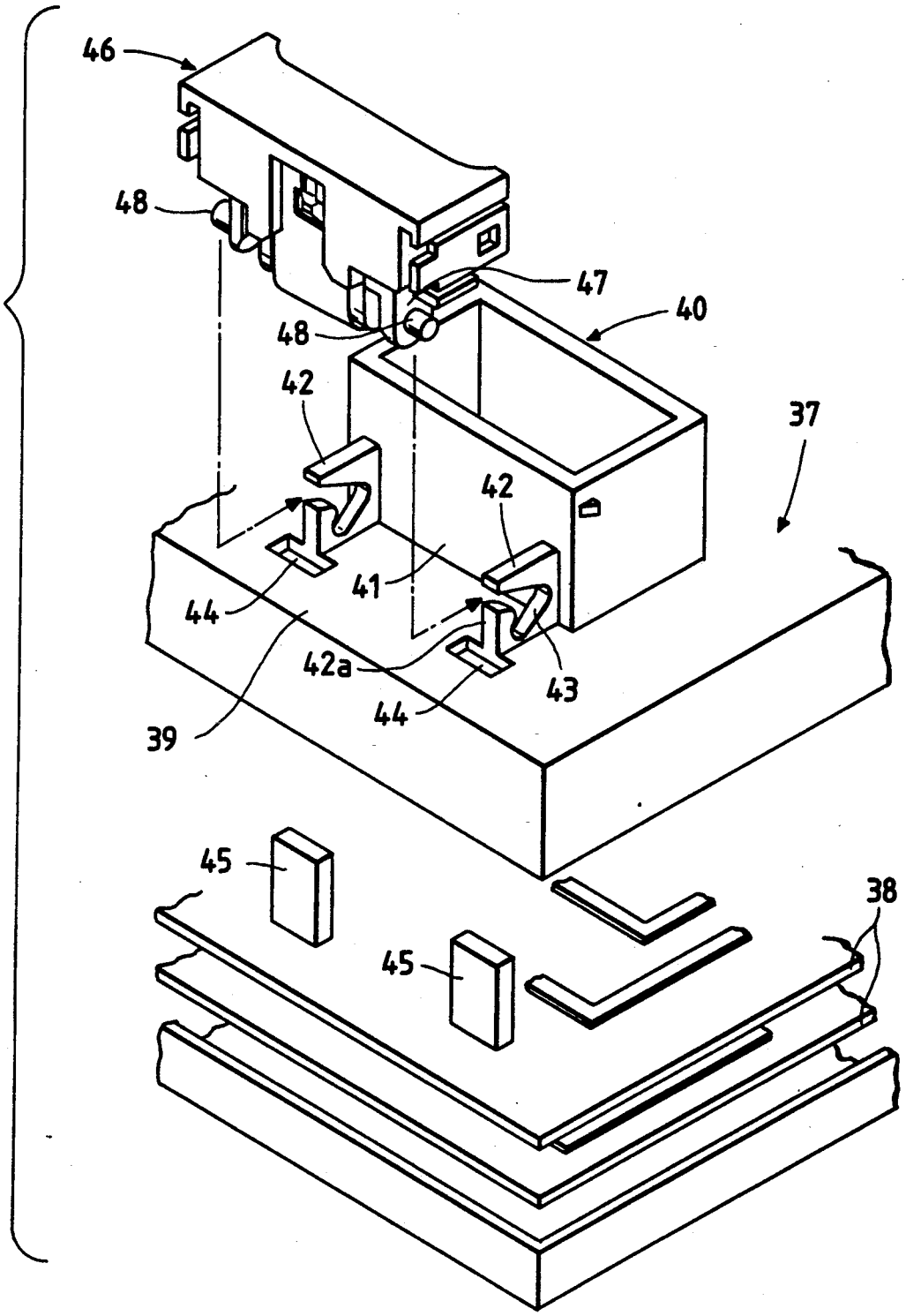
Figure 9A:
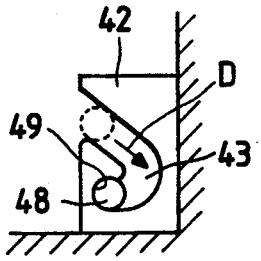
Figure 9B:
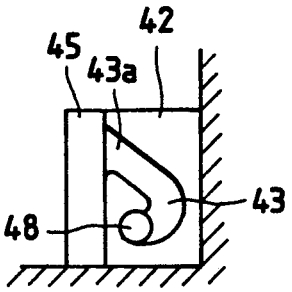
Figure 10A:
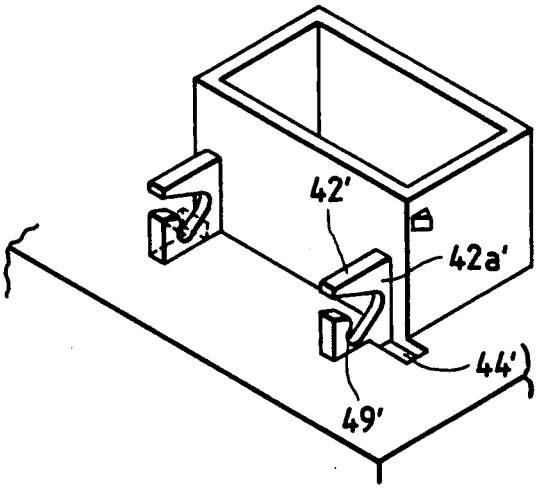
Figure 10B:
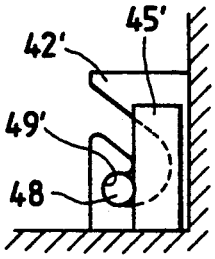
Figure 11:
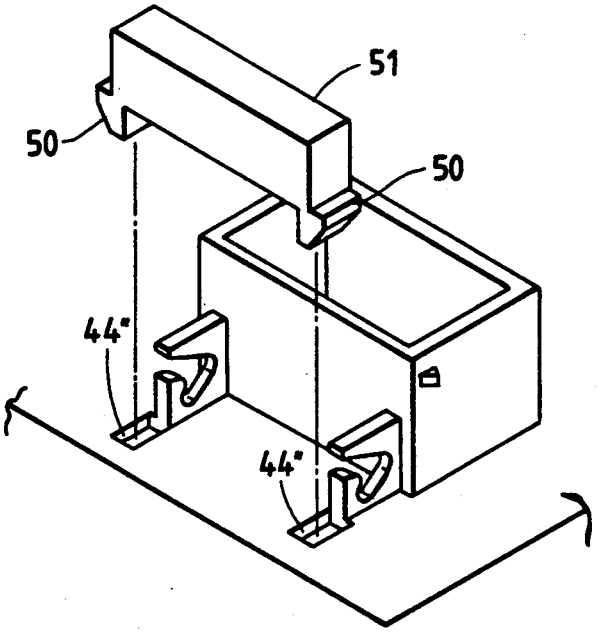
Figure 12:
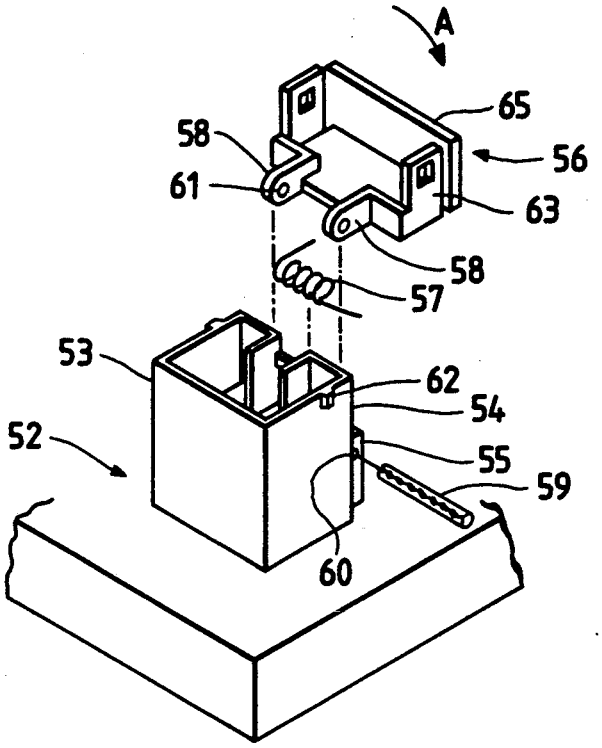
Figure 13A:
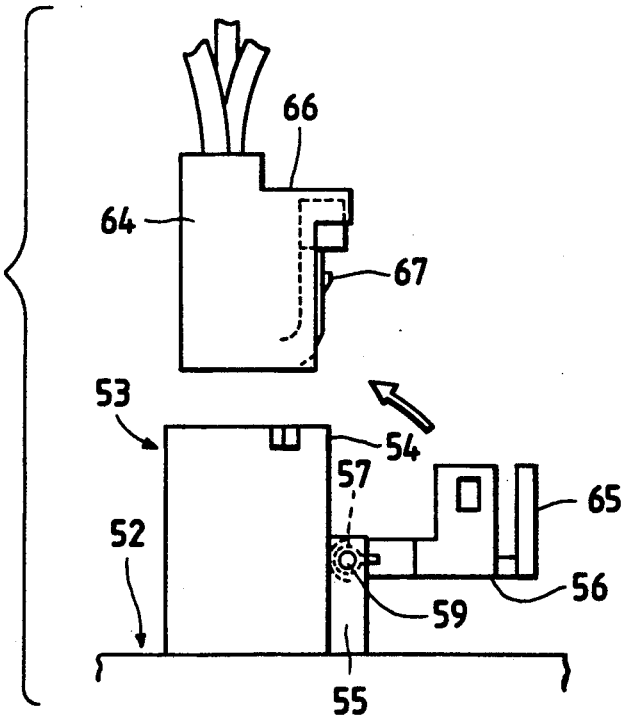
Figure 13B:
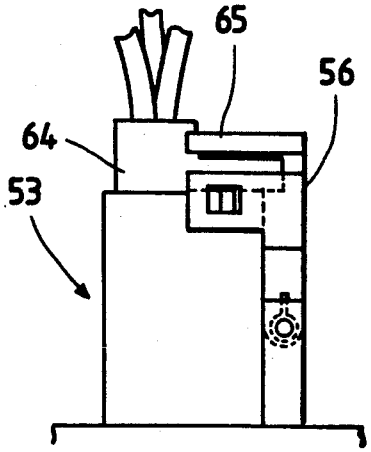
Figure 14:
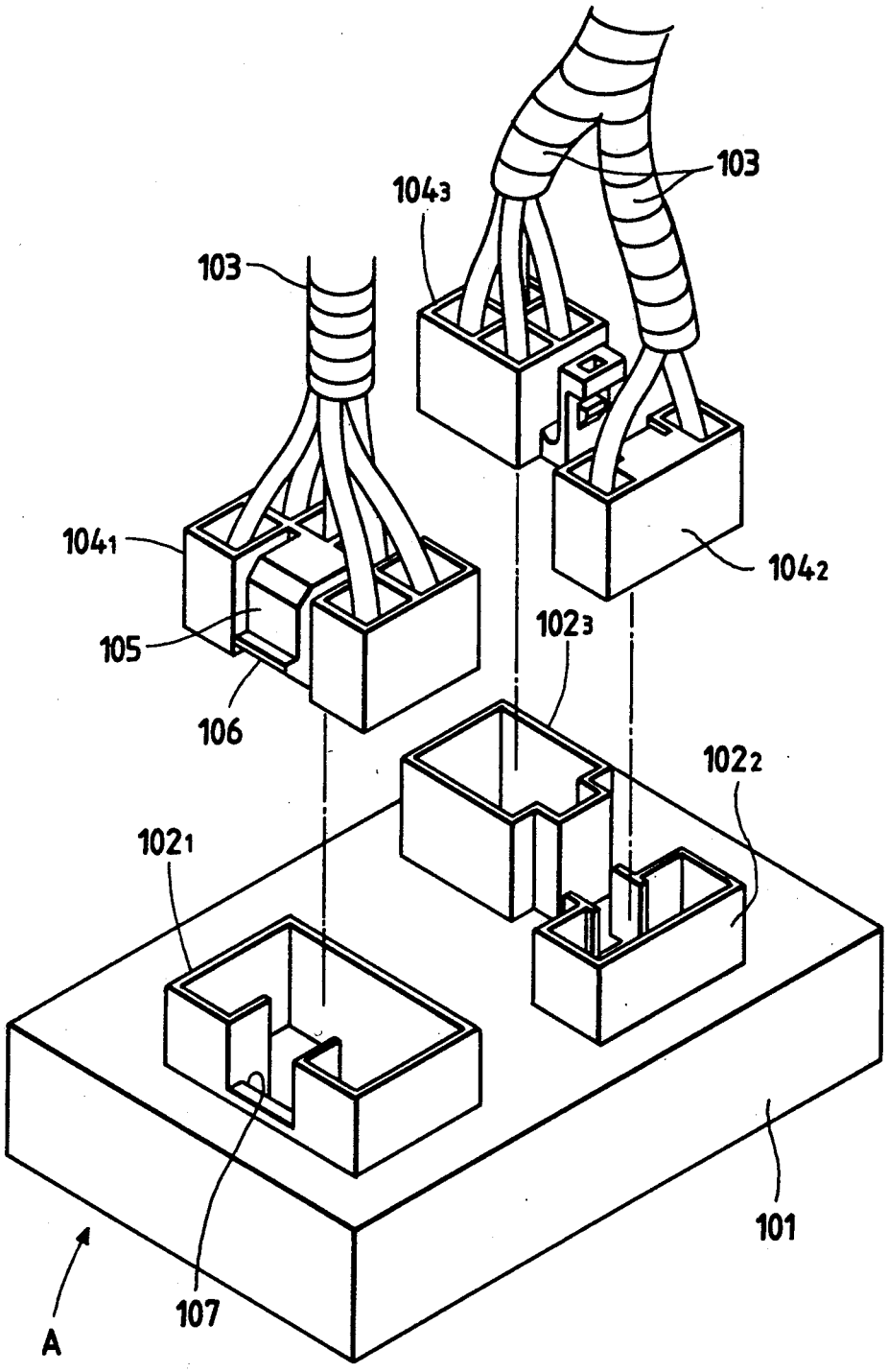
PRIOR ART FIG. 14

FIGS. (*a*), 2(*b*) and 2(*c*) are views of the first preferred embodiment illustrating how to attach the plate spring thereof;

FIG. 3 is a perspective view of the first preferred embodiment illustrating how to attach the locking unit thereof;

FIG. 4 is a cross-sectional view of the first preferred embodiment illustrating how to lock connectors;

FIG. 5 is a perspective view of the first preferred embodiment when the connectors are locked to each other;

FIG. 6 is a perspective view of a connector locking mechanism which is a modification of the first preferred embodiment;

FIG. 7 is a partial side view of a connector locking mechanism of another modification of the first preferred embodiment;

FIG. 8 is a perspective exploded view of a connector locking mechanism which is a second preferred embodiment of the present invention;

FIG. 9(*a*) is a partial side view of the second embodiment shown in FIG. 8, illustrating how to engage the pivots in pivot support plates;

FIG. 9(*b*) is a partial side view of the second embodiment shown in FIG. 8, illustrating how to fit the anti-disengagement members on the pivot support plates;

FIG. 10(*a*) is a perspective view of a connector locking mechanism which is a modification of the second preferred embodiment;

FIG. 10(*b*) is a partial side view of the modification shown in FIG. 10(*a*);

FIG. 11 is a perspective view of a connector locking mechanism which is a modification of the second preferred embodiment;

FIG. 12 is an exploded view of a related connector locking mechanism;

FIGS. 13(*a*) and 13(*b*) are partial side views of a connector illustrating how to lock the connectors; and FIG. 14 is an exploded view of a conventional connector locking mechanism.

DETAILED DESCRIPTION OF THE PREFERRED EMBODIMENTS

FIG. 12 is an exploded view of a related device for locking a pair of connectors to each other (NOT PRIOR ART). FIGS. 13(*a*) and 13(*b*) are side views of this device illustrating the operation thereof. The device includes pivot support members 55, locking unit 56, helical spring 57, and pivot pin 59, as shown in FIG. 12. Housing 53 of one of the connectors is provided on electric connection box 52. Pivot support members 55 are provided on wall 54 of housing 53. Locking unit 56 is pivotally supported by pivot pin 59 and pivot support members 55, so as to be rotatable about pin 59, and is biased by helical spring 57 in direction A so as to tend to unlock the connectors from each other.

Upon assembly, helical spring 57 is placed between support members 58 and pivot pin 59 is then fed through pin holes 60 of pivot support member 55, holes 61 of support members 58 and spring 57. Locking unit 56 has engagement members 63 provided at both ends of the unit so as to be engaged with engagement projections 62 of the housing 53. Locking plate 65 is provided at the top of the unit so as to be engaged on the other connector 64 as shown in FIG. 13(*b*).

To lock the connectors to each other, connector 64 is fitted in housing 53 and locking unit 56 is pivoted so that locking plate 65 is engaged on overhangs 66 of connector 64, thus preventing connector 64 from separating from housing 53, as shown in FIGS. 13(*a*) and 13(*b*).

Since engagement projection 67 of connector 64 is engaged with housing 53 and locking plate 65 is engaged with overhangs 66 of connector 64, both the connectors are redundantly engaged with each other and thus locked in a connected position. However, it is time-consuming and troublesome to attach locking unit 56 to housing 53, because it is necessary to set helical spring 57 and align pin holes 60 and 61 of pivot support members 55 and support members 58. Thus, assembly of this type of connector is difficult.

Embodiments of the present invention are hereafter described in detail with reference to the drawings attached hereto.

Figure 1:
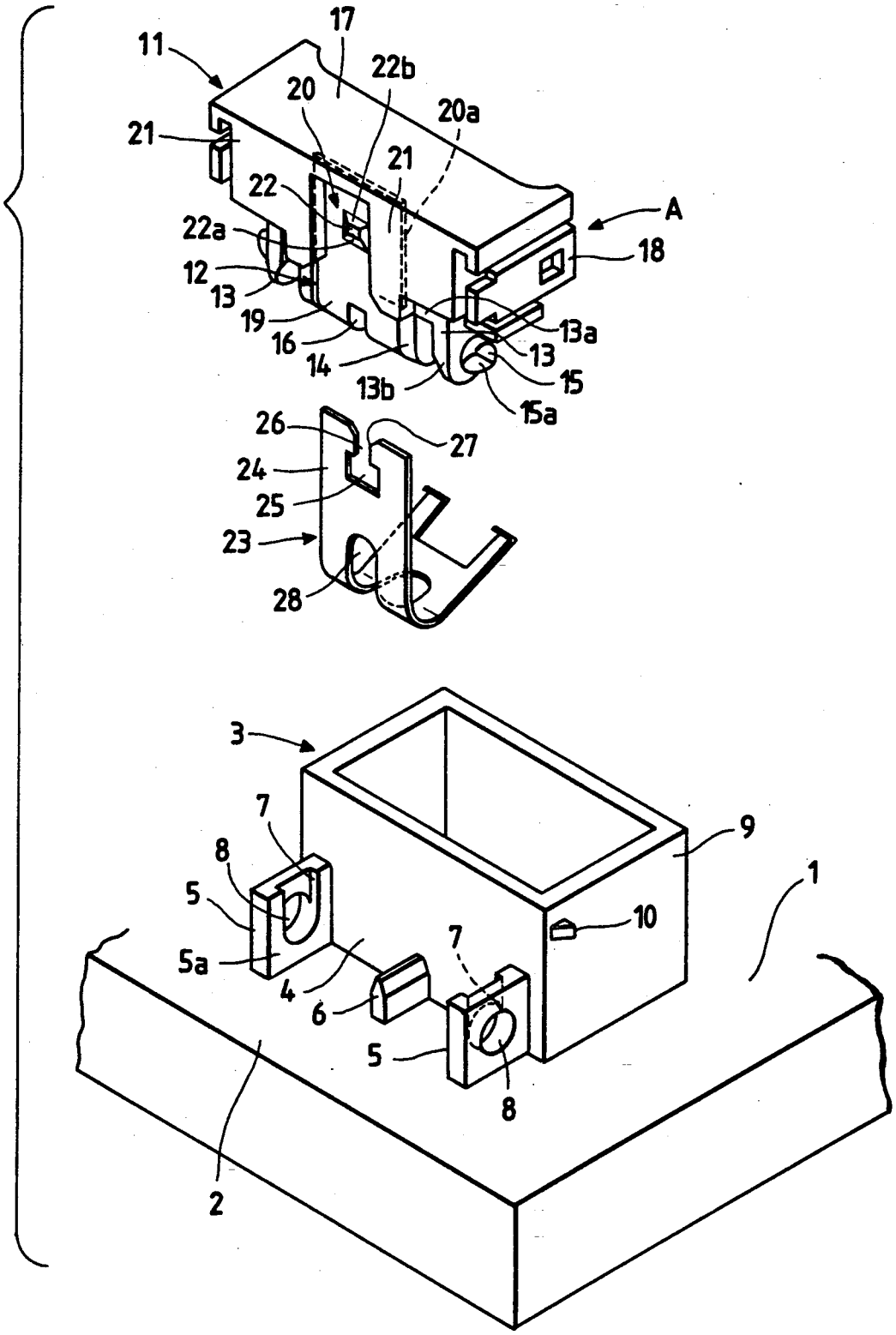
FIG. 1 is an exploded view of a connector locking mechanism of the first embodiment of the present invention.
Figure 2A:
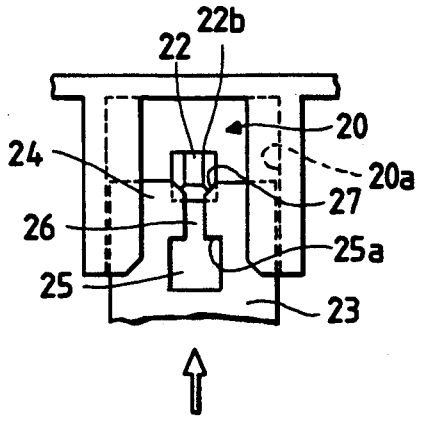
Figure 2B:
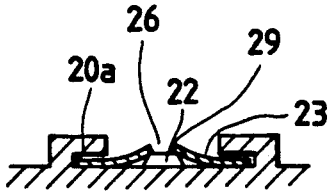
Figure 2C:
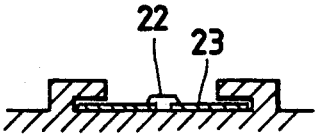

FIGS. 1, 2(*a*), 2(*b*), 2(*c*), 3, 4 and 5 show the first preferred embodiment of the present invention. The device includes a pair of supports plates 5, reinforcing insert plate 6, engagement projections 10, locking unit 11, and plate spring 23.

Housing 3 of one of the connectors is integrally provided on main surface 2 of electric connection box 1 made of a synthetic resin, or the like. Support plates 5 are provided on main surface 2 of box 1 and front 4 of connector housing 3. Reinforcing insert plate 6 is provided on main surface 2 of box 1 and front 4 of the connector housing 3 at a position between support plates 5. Each of support plates 5 has groove 7 extending in an inner side 5*a* of each support plate 5 from the top thereof to an intermediate portion thereof. Pivot hole 8 is located at the bottom of groove 7 so as to serves for pivotal coupling of locking unit 11. Engagement projections 10 are provided on both sides 9 of connector housing 3.

Locking unit 11 is thus pivotally coupled to housing 3. Locking unit 11 includes body 12, a pair of flexible support portions 13, a pair of short columns 15, fitting groove 16, locking plate 17, a pair of flexible engagement portions 18, and plate spring engagement portion 20. Flexible support portions 13 are provided on each of sides 14 of body 12. Each of support portions 13 has base part 13*a* on side 14, and flexible part 13*b* extended down from base part 13*a*. Short columns 15 are provided as pivotal coupling parts on the outer sides of the flexible parts 13*b* of and have lower oblique surfaces 15*a* so that the cross-sectional area of each of columns 15 gradually decreases from base part 13*a* toward the tip thereof. Thusly, the insertion ease of column 15 is improved. Fitting groove 16 is provided in the lower portion of body 12 so that reinforcing insert plate 6 is accommodated therein. Flexible engagement portions 18 are provided at both ends of locking plate 17 so as to engage with engagement projections 10 on connector housing 3 when mating connector 33, shown in FIGS. 4 and 5, is engaged with locking plate 17. Spring engagement portion 20 is provided at front portion 19 of body 12, and has a pair of guide walls 21 parallel with the front portion 19, insertion slit 20*a*, between front portion 19 and guide walls 21, and engagement projection 22 provided on front portion 19 at a position between guide walls 21. Engagement projection 21 has oblique surface 22*a* on the top and both sides projection and flat surface 22*b* on the bottom thereof so that the cross-sectional area of engagement projection 21 gradually decreases from the base thereof toward the tip thereof.

Tip portion 24 of plate spring 23 is shaped as a J and is inserted into insertion slit 20*a* of plate spring engagement portion 20 and is fixedly engaged therein. Tip portion 24 has engagement hole 25, opening 26, nicks 27, and clearance hole 28, for accommodating insert plate 6. Engagement projection 22 is fitted in engagement hole 25. Opening 26 extends from engagement hole 25 in the direction of the insertion of tip portion 24. Nicks 27 are provided at the outer end of opening 25 so that nicks 27 diverge outward.

Fitting plate spring 23 in plate spring engagement portion 20 will now be described in detail with reference to FIGURES 2(*a*), 2(*b*) and 2(*c*). Tip portion 24 of spring 23 is inserted into insertion slit 20*a* of engagement portion 20, as shown in FIG. 2(*a*). As a result, the width of opening 20 is increased, and edges 29 of tip portion 24, which extend along the opening, move up onto engagement projection 22, as shown in FIG. 2(*b*). Subsequently, engagement projection 22 is fitted in engagement hole 25, the edges extending along opening 20 return to their original positions, and edges 25*a* of tip portion 24, which extend on the top of engagement hole 25 as shown in FIG. 2(*a*), are engaged with flat surface 22*b* of engagement projection 22, as shown in FIG. 2(*c*).

FIG. 3 shows the rear of locking unit 11. Body 12 of locking unit 11 has slope 31 at rear portion 30 so that flexible support portions 13 can be easily fitted in support plates 5 by pushing on slope 31 with jig rod 32, or the like. The angle $\alpha$ of the obliqueness of slope 31 is appropriately set to prevent engagement portions 18 from interfering with engagement projections 10 when flexible support portions 13 are fitted in support plates 5 by pushing on slope 31 with jig rod 32. At this time, oblique surfaces 15*a* of columns 15 face downward to ease fitting of columns 15 in grooves 7 of support plates 5. At the same time, flexible support portions 13 are flexed inward so that columns 15 are slid and fitted into pivot holes 8 of support plates 5.

FIG. 4 illustrates locking unit 11 after attachment to connector housing 3. Spring plate 23 is engaged at one end thereof in locking unit 11 and disposed at the other end thereof in contact with front portion 4 of connector housing 3 so as to bias locking unit 11 in a direction A tending to unlock the housing 3 and mating connector 33. After mating connector 33 is inserted into housing 3 of the other connector so as to engage projections 35 and 36 with each other, locking unit 11 is pivoted in direction B so as to engage locking plate 17 on front surface 34 of connector 33. As a result, housing 3 and mating connector 33 are locked to each other, as illustrated in FIG. 5. Even if an external force thereafter acts to locking unit 11 in a longitudinal direction C thereof, reinforcing insert plate 6 keeps locking unit 11 from being moved laterally so as to undesirably disengage from the support plates 5.

FIG. 6 illustrates a modification of the first embodiment described above. Reinforcing insert plate 6' is provided on locking unit 11, and fitting hole 16' is provided in electric connection box 1. When locking unit 11 is installed, as described above, on connector 3, insert plate 6' fits into fitting hole 16, so as to increase resistance to lateral movement by locking unit 11.

FIG. 7 shows a mechanism which is another modification of the embodiment described above. Plate spring engagement projection 22' is provided on rear 30' of locking unit 11, and a plate spring 23 is resiliently disposed between the rear of the unit and connector housing 3. This modification insures that plate spring 23 is positively secured.

FIGS. 8, 9(*a*) and 9(*b*) illustrate a second preferred embodiment of the invention. The second embodiment includes a pair of pivot support plates 42, a pair of rectangular holes 44, a pair of anti-disengagement rectangular members 45, locking unit 46, and a plate spring not shown in the drawings. Housing 40 of one of the connectors is provided on main surface 39 of an electric connection box in which bus bar circuit boards 38 are housed. Pivot support plates 42 are provided on main surface 39 of box 37 and front 41 of connector housing 40. Each of support plates 42 has engagement opening 43 extending obliquely downward from front end 42*a* of plate 42. Engagement openings 33 are shaped substantially as a J. Main surface 39 of box 37 has rectangular holes 44 adjacent to front ends 42*a* of support plates 42. Anti-disengagement rectangular members 45 are set up on upper circuit board 38 and inserted up into rectangular holes 44 so that pivots 48 of locking unit 46, which are provided at outer sides 47 of other portions of the unit, are prevented from moving out of engagement openings 43 of support plates 42. Locking unit 46 is attached to connector housing 40. Pivots 48 are put into engagement openings 43 of support plates 42 (as shown by the arrow in FIG. 9(*a*)), and are then fitted in inner end portions 49 of openings 43. When circuit boards 38 are disposed in connection box 37, anti-disengagement members 45 on the upper circuit board are inserted into rectangular holes 44 of connection box 37 so as to close the outer ends of engagement openings 43 as shown in FIG. 9(*b*). This prevents pivots 38 from moving out of engagement openings 33.

FIGS. 10(*a*) and 10(*b*) show a device which is a modification of the second preferred embodiment. In the modification shown in FIGS. 10(*a*) and 10(*b*), rectangular holes 44' are provided in an electric connecting box adjacent to outer sides 42*a*' of pivot support plates 42, and anti-disengagement rectangular members 45' are inserted into rectangular holes 44' and placed in contact with pivots 48 fitted in inner end portions 49' of engagement openings 43 of pivot support plates 42. This arrangement also insures that pivots 48 will not move out of end portions 49.

FIG. 11 shows a mechanism which is another modification of the second embodiment. An anti-disengagement member 5 having a pair of engagement hooks 50 is provided so that the hooks are fitted in rectangular holes 44". This is yet another arrangement that insures that pivots 48 are secured in end portions 49.

While the the present invention has been described in relation to the preferred embodiments, and modifications thereof, the scope of the present invention is not confined to these embodiments and modifications, but may be modified or practiced in various ways without departing from the spirit or essential character of the invention as recited in the appended claims.

What is claimed is:

1. A locking device for securing a pair of connectors in engagement with each other, comprising:

at least one support portion formed on a housing of one of the connectors;

a locking unit pivotally connected to said support portion, said locking unit being engaged with the other of the connectors, when said locking unit it pivoted to a first position, so as to lock said connectors into engagement with each other, said locking unit being disengaged from said other connector, when said locking unit is pivoted to a second position; and a spring, resiliently disposed between said housing and a portion of said locking unit so as to bias said locking unit into said second position wherein an insert plate is formed on one of said housing and said locking unit and a groove is provided on the other of said housing and said locking unit, said groove being adapted to receive said insert plate so as to prevent relative movement between said locking unit and said housing.

2. A locking device for securing a pair of connectors in engagement with each other, comprising:

at least one support portion formed on a housing of one of the connectors, said support portion having an engagement opening formed thereon;

a locking unit having at least one engagement projection formed thereon, said engagement projection being adapted for operative engagement with said engagement opening so as to pivotally support said locking unit on said housing, said locking unit being engaged with the other of the connectors, when said locking unit is pivoted to a first position, so as to lock said connectors into engagement with each other, said locking unit being disengaged from said other connector, when said locking unit is pivoted to a second position; and a spring, resiliently disposed between said housing and a portion of said locking unit so as to bias said locking unit into said second position wherein an insert plate is formed on one of said housing and said locking unit and a groove is provided on the other of said housing and said locking unit, said groove being adapted to receive said insert plate so as to prevent relative movement between said locking unit and said housing.

3. A locking device as claimed in claims 1 or 2 further comprising:

means for securing an end portion of said spring to said locking unit, comprising an insertion slit and a salient portion formed on said locking unit, said spring being of a plate type and having an opening formed thereon at said end portion;

said end portion being received in said slit and said salient portion being received in said opening when the locking device is assembled.

4. A device as claimed in any one of claims 1 or 2, further comprising:

means for receiving a rod so as to allow said locking unit to be pivotally attached to said housing by a force placed on said receiving means by said rod, said receiving means having a sloped surface for engagement with the rod so as to allow said force to be applied while said locking unit is oriented at an angle associated with said second position.

5. A locking device for securing a pair of connectors in engagement with each other, comprising:

at least one support portion formed on a housing of one of the connectors, said support portion having an engagement opening formed thereon;

a locking unit having at last one engagement projection formed thereon, said engagement projection being adapted for operative engagement with said engagement opening so as to pivotally support said locking unit on said housing, said locking unit being engaged with the other of the connectors, when said locking unit is pivoted to a first position, so as to lock said connectors into engagement with each other, said locking unit being disengaged from said other connector, when said locking unit is pivoted to a second position; and a spring, resiliently disposed between said housing and a portion of said locking unit so as to bias said locking unit into said second position, wherein said housing is secured to a connection box having an aperture proximate each of said support portions, and a retaining member is adapted for insertion into each of said apertures so as to maintain operative engagement between said engagement projections and said engagement openings.

6. A locking device as claimed in claim 5 wherein an insert plate is formed on one of said housing and said locking unit and a groove is provided on the other of said housing and said locking unit, said groove being adapted to receive said insert plate so as to prevent relative movement between said locking unit and said housing.

* * * * *